US008430048B2

(12) United States Patent
Tamulewicz et al.

(10) Patent No.: US 8,430,048 B2
(45) Date of Patent: Apr. 30, 2013

(54) LINE GUARD APPARATUS

(76) Inventors: Paul A. Tamulewicz, Berea, OH (US); Thomas E. Tamulewicz, Hinckley, OH (US)

( * ) Notice: Subject to any disclaimer, the term of this patent is extended or adjusted under 35 U.S.C. 154(b) by 197 days.

(21) Appl. No.: 12/931,837

(22) Filed: Feb. 11, 2011

(65) Prior Publication Data

US 2012/0204778 A1 Aug. 16, 2012

(51) Int. Cl.
*B63B 21/04* (2006.01)

(52) U.S. Cl.
USPC ..... 114/218; 24/129 R

(58) Field of Classification Search ..... 114/218; 24/129 R, 115 R, 130
See application file for complete search history.

(56) References Cited

U.S. PATENT DOCUMENTS

| | | | | |
|---|---|---|---|---|
| 3,082,730 | A | | 3/1963 | Good |
| 3,233,934 | A | | 2/1966 | Osborn et al. |
| 3,574,900 | A | | 4/1971 | Emery |
| 3,812,811 | A | | 5/1974 | Rodriguez |
| 3,865,065 | A | | 2/1975 | Dennis et al. |
| 3,905,322 | A | * | 9/1975 | Peterman et al. ..... 114/218 |
| 4,248,171 | A | | 2/1981 | Barbour |
| 4,361,938 | A | | 12/1982 | Emery |
| D291,058 | S | | 7/1987 | Sorensen |
| 5,477,800 | A | * | 12/1995 | Lawrence ..... 114/218 |
| 5,730,077 | A | | 3/1998 | Nunes et al. |
| 5,987,711 | A | | 11/1999 | Parsons |
| 5,996,524 | A | | 12/1999 | Johnson |
| 6,009,824 | A | * | 1/2000 | Ross ..... 114/218 |
| 6,202,585 | B1 | | 3/2001 | Alan |
| 6,260,498 | B1 | | 7/2001 | Cochran |
| 6,349,662 | B1 | | 2/2002 | Limansky et al. |
| 6,733,161 | B2 | | 5/2004 | Tufte |
| 6,843,196 | B1 | | 1/2005 | Richardson et al. |
| 7,299,759 | B2 | | 11/2007 | Francis |
| 7,464,443 | B2 | * | 12/2008 | Lopes Praca ..... 24/129 R |
| 7,685,956 | B2 | | 3/2010 | Hynes |
| 2006/0174811 | A1 | | 8/2006 | Jungblom et al. |

* cited by examiner

*Primary Examiner* — Lars A Olson
(74) *Attorney, Agent, or Firm* — Hudak, Shunk & Farine Co. LPA

(57) ABSTRACT

An apparatus designed to be mounted on a surface of a watercraft and including a line guard adapted to provide protection against damage to the painted surface and cosmetic trim of the watercraft from lines, such as one used for anchoring. The apparatus is designed in one embodiment to accept a line-holding member such as a cleat, clamp or the like.

18 Claims, 4 Drawing Sheets

LINE GUARD APPARATUS

FIELD OF THE INVENTION

The present invention relates to an apparatus designed to be mounted on a surface of a watercraft and including a line guard adapted to provide protection against damage to the painted surface and cosmetic trim of the watercraft from lines, such as one used for anchoring. The apparatus is designed in one embodiment to accept a line-holding member such as a cleat, clamp or the like.

BACKGROUND OF THE INVENTION

Various line cleats, line clamps and line roller guides have been designed to mount and receive lines on watercraft. Although effective at securing the vessel when used for anchoring or docking, for example, available cleat and clamp designs provide little if nothing at all towards protecting the outer surface of the vessel that contacts the line and connected items that can cause damage such as an anchor chain and anchor. See for example U.S. Des 291,058; U.S. Pat. Nos. 3,233,934; 3,574,900; 3,812,811; 4,361,938; 5,987,711; and 6,260,498.

Line roller guides and bowsprits that are designed specifically for anchor line use may provide some protection to the outer cosmetics of the vessel, but oftentimes mount and protrude so far from the vessel's edge that they prohibit the use of a protective boat cover unless the cover is specifically tailored to fit over them. See for example U.S. Pat. Nos. 3,082,730; 3,865,065; 4,248,171; 5,996,524; 6,843,196; 7,299,759 and U.S. Publication No. 2006/0174811;

Other extruded strips or rub rails conceived to fit over or near the gunwale of a vessel also provide protection against chaffing damage from lines, but offer limited coverage of all potential surfaces likely to be exposed to connected items that can cause damage such as anchor chain and anchors, for example. See for example U.S. Pat. Nos. 5,730,077; 6,202,585; 6,349,662; 6,733,161 and 7,685,956.

SUMMARY OF THE INVENTION

In view of the above, it is an object of the present invention to provide a line guard apparatus able to protect a portion of two adjoining surfaces of a watercraft, in one embodiment an upper surface or gunwale and a side surface.

Another object is to provide a line guard apparatus adapted to be positioned adjacent a cleat or clamp, or be integrally joined with a cleat, clamp or the like, the apparatus including a top panel and a side panel, the top panel including two or more guide posts protruding upwardly from the top panel and located towards the outer edge of the panel adapted for maintaining a line within a central portion of the line guard apparatus.

A further object of the present invention is to provide the line guard apparatus with a top panel with a guide ramp tapering downwardly from a guide post, generally towards the center of the top panel in order to guide a line towards a center portion of the apparatus. In a useful embodiment, the ramp has a height that ends below the top of the post.

Another object of the present invention is to provide a line guard apparatus having a top panel and a side panel connected at an angle, the top panel including a guide post having a portion flush with an outer edge of the top panel and a guide ramp extending downwardly from the ramp towards a central portion of the top panel.

Still another object of the present invention is to provide a line guard apparatus having a top panel including apertures that allow securement of a cleat, clamp or the like thereto.

According to the present invention there is provided a line guard comprising a substantially horizontal top panel that abuts to a substantially vertical side panel at an angle, the top panel length is extended to reach and provide a mounting surface from the edge of the vessel inward to a utility cleat location, the side panel length is extended from the edge of the vessel downward for coverage of a portion of the side hull, the overall width of the panels sufficient for clearance between cover buttons and other items attached to a vessel; and two guide posts protruding upward from the top panel positioned near the apex and flush with the outer side edges to maintain lateral line force, with two apex ramps forward of each post starting flush from top panel center then tapered upward to the outer side edges to maintain axial line force and keep the line within the center portion of the guard.

The guard apparatus may mount between the topside surface at the gunwale of a watercraft and an existing utility cleat via use of the utility cleat mounting method and hole locations. Contact rib details protruding from the inside surface of the vertical side panel run flush with each outer side edge to rigidly position the guard against the curve of a boat's hull.

One aspect of the invention is a line guard apparatus, comprising a top panel connected to a side panel, wherein an angle between the top panel and side panel ranges from about 60 to about 120 degrees; a pair of guide posts connected to and extending upwardly from the top panel; and a guide ramp having a first end connected to a portion of each guide post and a second end connected to the top panel, the first end having a greater height than the second end, wherein the second end is located closer to a central portion of the panel than the first end.

Another aspect of the invention is a line guard comprising an integral horizontal top panel abutting on an angle to a vertical side panel having a rounded apex, the top panel having a length adapted to receive a utility cleat and side panel having a length adapted for protective coverage; a set of top guide posts protruding from the horizontal top panel and adapted to maintain line contact; a set of guide ramps merging with the guide posts and adapted to further maintain line to a relatively central position; and a set of ribs on an inside surface of the vertical side panel adapted to contact curved contours of a watercraft.

BRIEF DESCRIPTION OF THE DRAWINGS

An example of a preferred embodiment will now be described in reference to the drawings, in which.

DETAILED DESCRIPTION OF THE INVENTION

Figure 1:
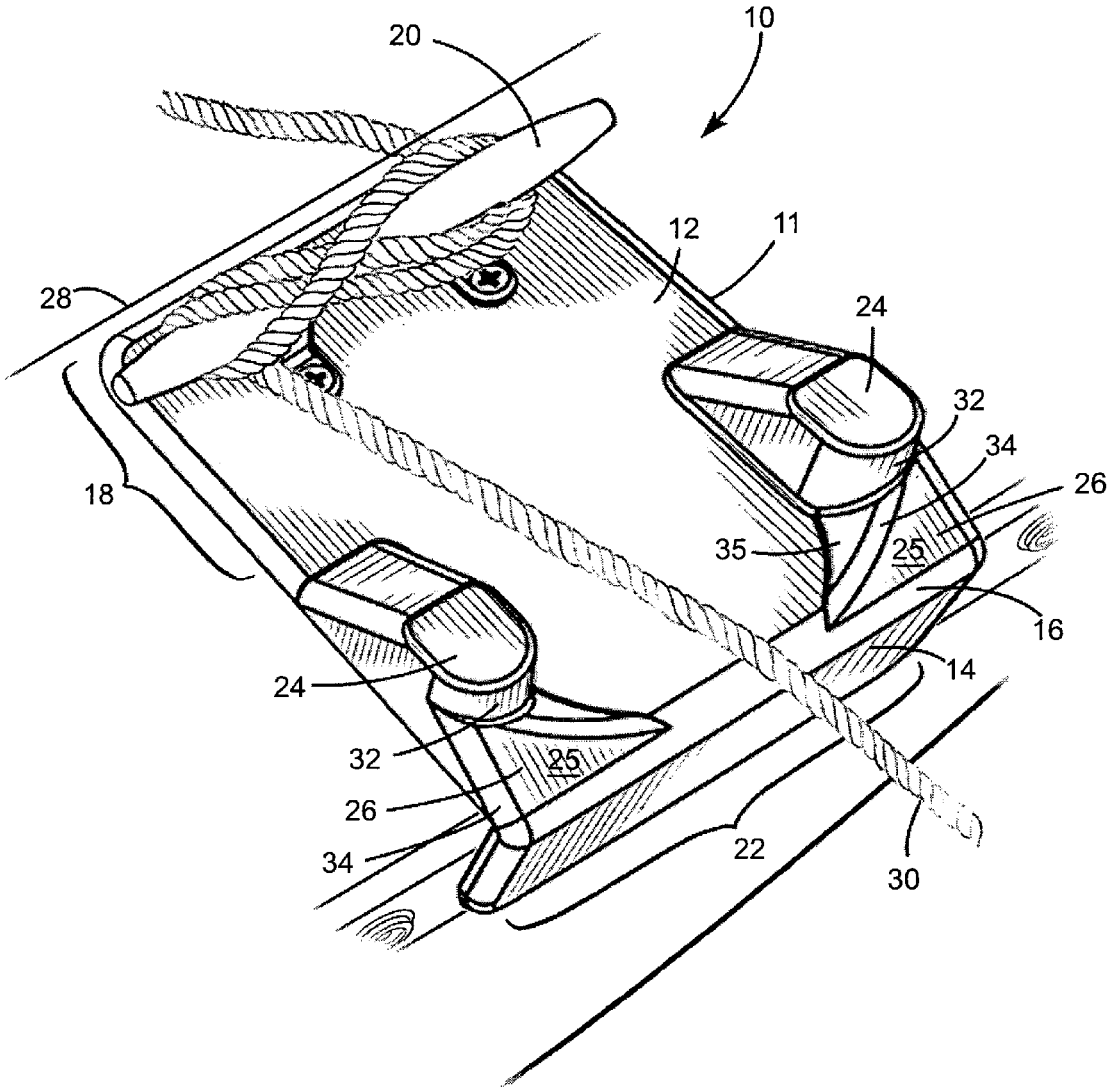
FIG. 1 illustrates one embodiment of the line guard apparatus shown in an upper left side perspective view mounted to the topside portion of a watercraft in use with a utility cleat and anchor line.

The drawings show a line guard apparatus 10 comprising a base 11 having a top panel 12 connected to a side panel 14. In one embodiment the top panel 12 is adapted to be disposed on a substantially horizontal surface of a watercraft and the side panel 14 is adapted to be disposed on a substantially vertical side surface of a watercraft. The top panel 12 and side panel 14 abut at an apex 16. In one embodiment the apex 16 is rounded or angled or a combination thereof in order to reduce line fray and in some embodiments match a contour of a portion of the watercraft adjacent thereto. The top panel 12 is extended in length to provide mounting area 18 for a utility cleat 20. In other embodiments the top panel 12 extends a distance up to a utility cleat 20 for a clamp or the like already present on a surface of a boat. In one embodiment the length of the top panel ranges generally from about 8 to about 25 cm, desirably from about 10 to about 20 cm and preferably from about 10 to about 17 cm. The side panel 14 is extended in length to provide a coverage area 22. In one embodiment the length of the side panel ranges generally from about 2 to about 16 cm, desirably from about 2 to about 10 cm and preferably from about 4 to about 6 cm. In one embodiment the width of the top and side panels, independently, range generally from about 10 to about 18 cm, desirably from about 10 to about 15 cm, and preferably from about 12 to about 15 cm. The line guard 10 may be preferably molded from a resilient plastic such as nylon, but may also be molded or formed from other materials including but not limited to polymers such as acetal, acrylic, polycarbonate, polypropylene, polyethylene, polystyrene, polyurethane, epoxy, fiberglass resin, and metals such as brass, aluminum, zinc and steel.

The line guard apparatus 10 further includes at least two guide posts 24 connected to and protruding upwardly from the outer surface of top panel 12, preferably near the apex 16. The guide post 24 can be connected to the top panel or integrally molded therewith with the latter being preferred in one embodiment. The line guard apparatus also includes a guide ramp 26 connected to each guide post 24. In one embodiment the top of the guide ramp is connected to the guide post at a height of about 33% to about 60% of the total height of the guide post. In a further embodiment the top of the guide ramp is connected at a height of about 35% to about 55% of the total height of the guide post. In one embodiment, the guide ramp has a front face 25 that is tangent to a rounded apex 16. The front face 25 tapers downwardly from the post towards a central portion of the top panel 12. The utility cleat is fastened to the top panel 12 utilizing fasteners in one embodiment as illustrated in FIG. 1. The line guard apparatus 10 can also be connected in other embodiments to a watercraft using one or more of fasteners and an adhesive.

Figure 4:
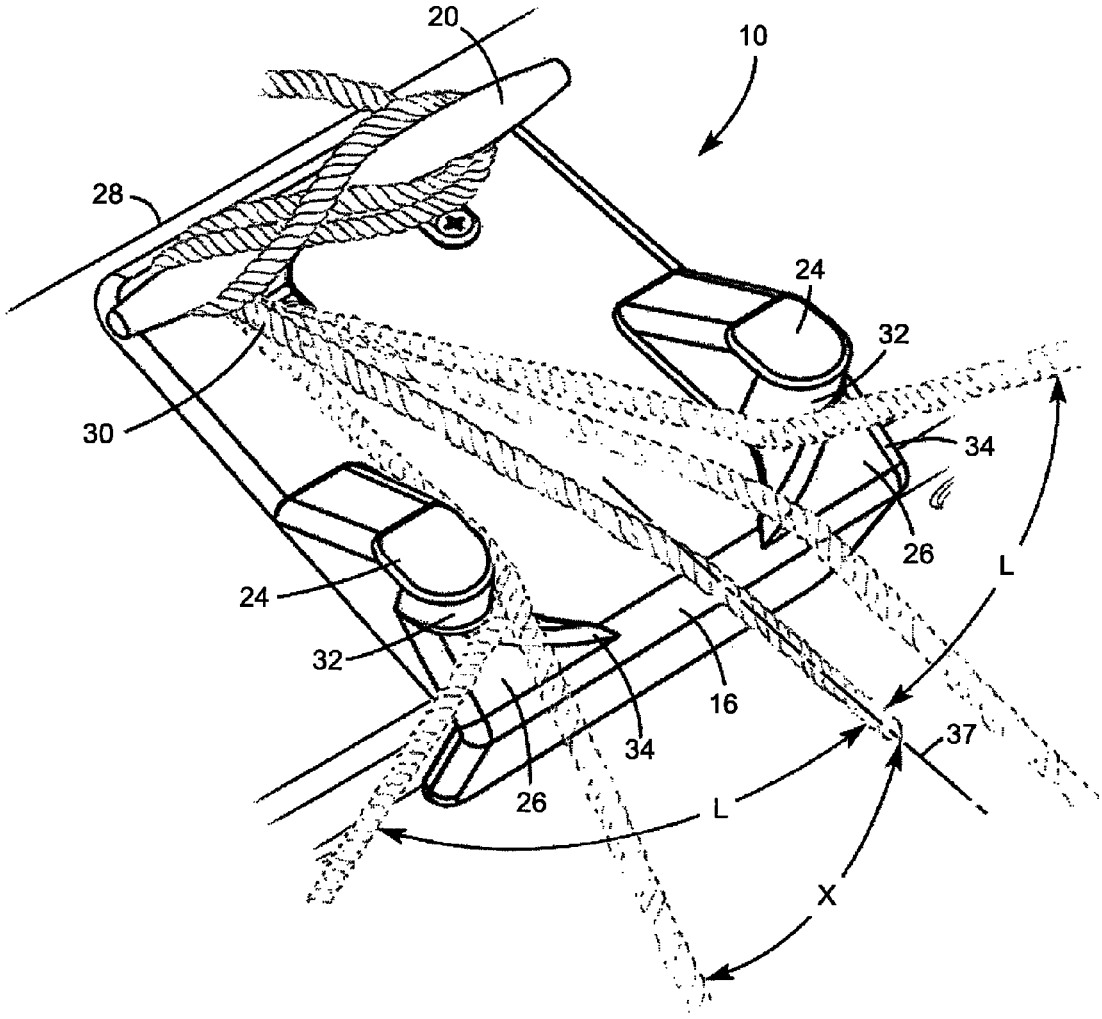
FIG. 4 is the line guard apparatus as shown in FIG. 1 illustrating functionality of integral guide details with lateral line force.

Referring to FIG. 1 and FIG. 4, the line guard apparatus 10 is shown mounted to the topside surface at the gunwale of a watercraft 28 in use with a utility cleat 20 and a utility line 30. Guide posts 24 extending from the top panel 12 feature a front radius 32 preferably located on an upper portion of the guide post 24 that provides a smooth and sheer surface for the line 30 when under lateral tension, as illustrated best in FIG. 4 with extreme lateral line positions L shown in phantom. Guide ramps 26 merge into the front radius 32 of the guide post 24 generally at a location between 40 percent and 60 percent of the height of the guide post 24 and preferably at about 50 percent of the height of the guide post 24. Ramp 26 has an upper edge 34 that extends from the post 24 downwardly towards a central portion of a top panel 12 and merges thereinto. The upper edge 34 provides a smooth and sheer surface for line 30. At its base, the upper edge 34 merges with apex 16 and serves to maintain downward axial force X on line 30 within a central position 37 on the line guard apparatus 10. Ramp 26 also includes an inner edge 35 extending downwardly from upper edge 34 to the surface of the top panel 12.

Figure 2:
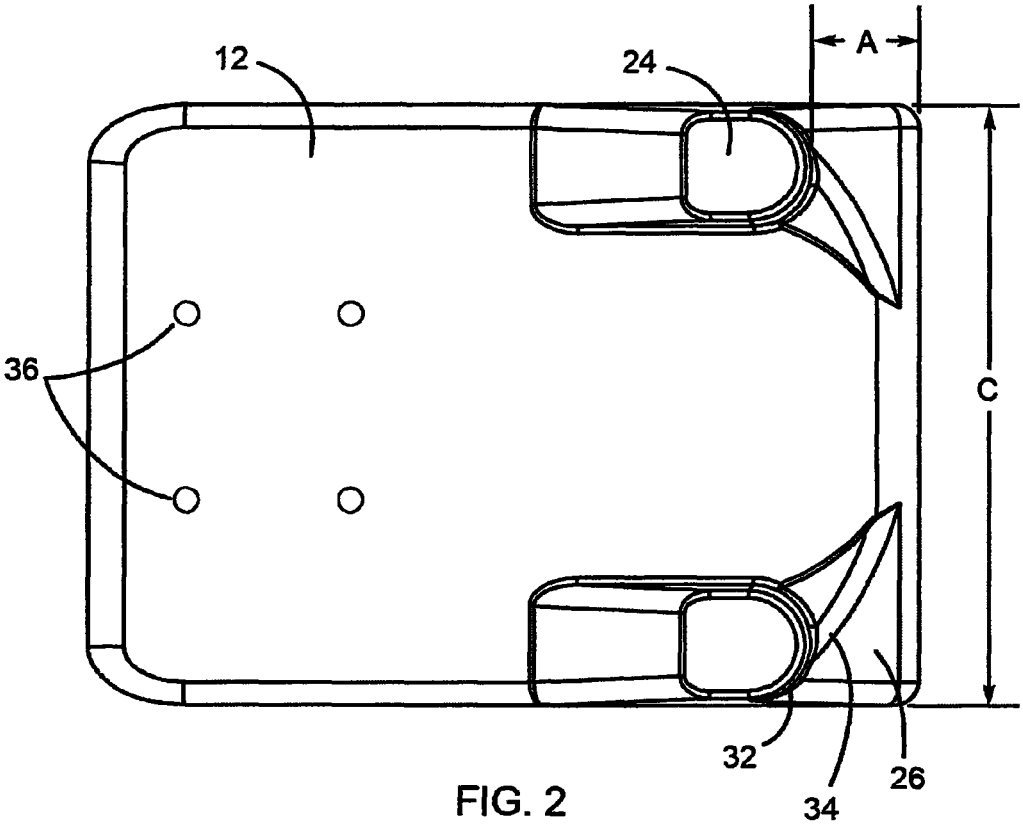
FIG. 2 is a top view of the line guard apparatus of FIG. 1.
Figure 3:
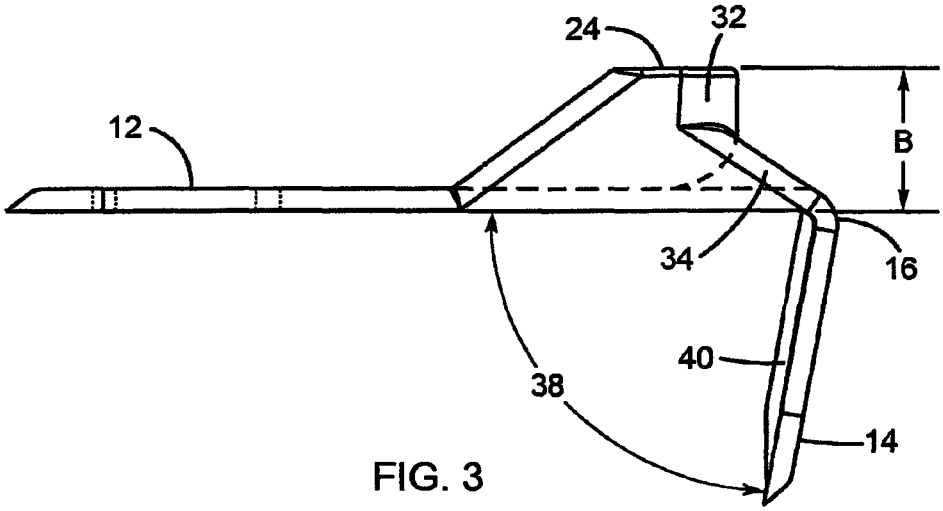
FIG. 3 is a side view of the line guard apparatus of FIG. 1.

FIG. 2 and FIG. 3 show respective front and side plan views of the line guard 10 not mounted to a watercraft 28 and utility cleat 20. In one embodiment, one or more clearance apertures 36 are placed through the top panel 12 to accommodate new or existing cleat 20 locations on the watercraft 28. The top panel 12 and side panel 14 abut at the rounded apex 16 to form an angle 38. Angle 38 between the planes of the top panel 12 and side panel 14 ranges generally from 60° to about 120°, desirably from about 70° to about 85° or 90° and preferably from about 75° to about 85°. Angle 38 can be varied in order to fit a number of different watercraft surfaces such as in one embodiment through forming apex 16 as a hinge such as a living hinge.

Figure 5:
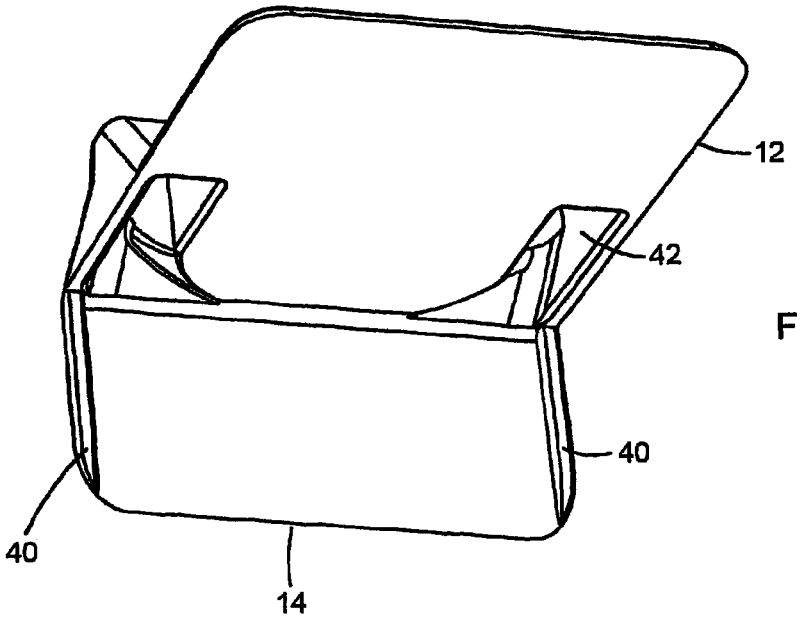
FIG. 5 is a bottom perspective view of the line guard apparatus of FIG. 1 showing contact rib details.

The front radius 32 on guide posts 24 merges with the top radii 34 on the guide ramps 26 which further merge with the rounded apex 16 to create smooth and sheer surfaces to interface with the utility line 30. With further reference to FIG. 5, integral contact ribs 40 protrude from the inside surface of the vertical side panel 14 and extend along a length of the side panel 14. The contact ribs 40 are flush with each outer edge of the line guard 10 and serve to secure the contact of the planar line guard 10 with the curve of a watercraft 28 hull. Pockets 42 are molded into the bottom of the line guard 10 to maintain a constant wall thickness throughout the apparatus in one embodiment.

Figure 6:
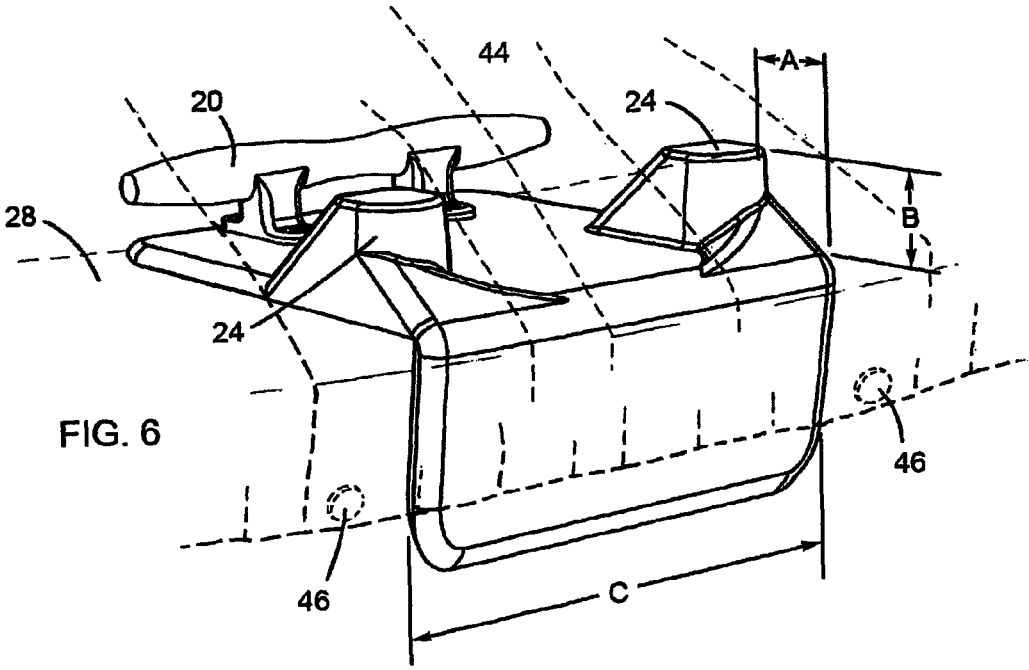
FIG. 6 is a front perspective view of the line guard apparatus of FIG. 1 illustrating advantages of streamlined guide details.

With further reference to FIG. 6, the guide posts 24 are located at a distance A from the rounded apex 16 to streamline the side profile and overall height B of the line guard 10 to fit protective boat covers 44. The overall width C of the line guard 10 is also of minimal span to accommodate fit of covers 44 as well, especially when they are attached by means of snap buttons 46 around the periphery of a watercraft 28. Distance A ranges generally from about 0 to about 5 cm, desirably from about 1 to about 4 cm, and preferably from about 2 to about 3 cm. Distance B ranges generally from about 2.5 to about 5 cm, desirably from about 2.5 to about 3.8 cm and preferably from about 2.5 to about 3.2 cm. Distance C ranges from generally from about 10 to about 18 cm, desirably from about 10 to 15 cm and preferably from about 12 to about 15 cm.

In view of the above, it has been demonstrated that the line guard apparatus is adapted to protect a surface of a watercraft from a line commonly utilized to secure the watercraft to another object, such as dock, etc. Guide post 24 in combination with ramps 26 maintain a line connected to a cleat or the like within the width of the top panel 12 and side panel 14. The location of the cleat or other mooring device in a back central portion of the top panel 12 aids in achieving the goals of the invention.

Finally it should be understood that the prior description refers merely to a preferred embodiment of the invention, with variations and modifications being possible without departing from the spirit and scope of the invention, encompassed by the following claims.

The invention claimed is:

1. A line guard apparatus, comprising:

a top panel connected to a side panel, wherein an angle between the top panel and side panel ranges from about 60 to about 120 degrees;

a pair of guide posts connected to and extending upwardly from the top panel with each guide post having a free upper end; and a guide ramp having a first end connected to a portion of each guide post and a second end connected to the top panel, the first, end having a greater height than the second end, wherein the second end is located closer to a central portion of the top panel than the first end.

2. The line guard apparatus according to claim 1, wherein the top panel includes two or more clearance apertures adapted to receive a cleat, the clearance apertures located further away from a junction of the top panel and side panel than the guide posts and guide ramps.

3. The line guard apparatus according to claim 1, wherein a junction between the top panel and the side panel is rounded, and wherein the guide ramp has a top end connected to the guide post at a height of about 33% to about 60% of the total height of the guide post.

4. The line guard apparatus according to claim 3, wherein the guide ramp is connected at a height of about 35% to about 55% of the guide post.

5. The line guard apparatus according to claim 3, wherein the guide post has a radius on a side of the guide post facing the side panel, and wherein the front radius merges with a top radius of the ramp.

6. The line guard apparatus according to claim 2, wherein a cleat is connected to the top panel through the clearance apertures using a fastener.

7. The line guard apparatus according to claim 1 wherein the guide posts are located on opposite edges of the top panel and having a portion in contact with said edge.

8. The line guard apparatus according to claim 1, wherein the side panel has a length of about 2 to about 16 cm, wherein the top panel has a length of about 8 to about 25 cm, wherein the side panel has a width of about 10 to about 18 cm, and the top panel has a width of about 10 to about 18 cm.

9. The line guard apparatus according to claim 1, wherein the apparatus is molded and the top panel, the side panel, the guide posts and the guide ramps have substantially the same thickness.

10. A line guard comprising:

an integral horizontal top panel abutting on an angle to a vertical side panel having a rounded apex, the top panel having a length adapted to receive a utility cleat and side panel having a length adapted for protective coverage;

a set of top guide posts protruding from the horizontal top panel and adapted to maintain line contact;

a set of guide ramps merging with the guide posts and adapted to further maintain line to a central position; and a set of ribs on an inside surface of the vertical side panel adapted to contact curved contours of a watercraft.

11. The line guard as claimed in claim 10, wherein the horizontal top panel includes a utility cleat fastened by utility cleat bolts through apertures in the top panel.

12. The line guard as claimed in claim 10, in which the guide posts and the guide ramps protrude from the horizontal top panel near and at the radius apex, and wherein the guide ramp has a top end connected to the guide post at a height of about 33% to about 60% of the total height of the guide post.

13. The line guard as claimed in claim 10, in which the guide posts and guide ramps feature radii that provide a smooth faring contact surface for utility lines.

14. The line guard as claimed in claim 11, in which the overall height and width of the guide posts and ramps are of streamline shape to accommodate protective boat covers, wherein the side panel has a length of about 2 to about 16 cm, wherein the top panel has a length of about 8 to about 25 cm, wherein the side panel has a width of about 10 to about 18 cm, and the top panel has a width of about 10 to about 18 cm.

15. A line guard apparatus, comprising:

a top panel connected to a side panel, wherein an angle between the top panel and side panel ranges from about 60 to about 120 degrees;

a pair of guide posts connected to and extending upwardly from the top panel with each guide post having a free upper end; and a guide ramp having a first end connected to a portion of each guide post and a second end connected to the top panel, the first end having a greater height than the second end, wherein the second end is located closer to a central portion of the top panel than the first end; and wherein the guide posts are located on opposite edges of the top panel and having a portion in contact with said edge.

16. The line guard apparatus according to claim 15, wherein the top panel includes two or more clearance apertures adapted to receive a cleat, the clearance apertures located further away from the junction of the top panel and side panel than the guide posts and guide ramps.

17. The line guard apparatus according to claim 15, wherein a junction between the top panel and the side panel is rounded, and wherein the guide ramp has a top end connected to the guide post at a height of about 33% to about 60% of the total height of the guide post.

18. The line guard apparatus according to claim 15, wherein a cleat is connected to the top panel through the clearance apertures using a fastener.

* * * * *